United States Patent [19]

Pansini

[11] 4,009,049

[45] Feb. 22, 1977

[54] STAIN REMOVER FOR SWIMMING POOLS, APPARATUS AND METHOD

[76] Inventor: Andrew L. Pansini, 200 Golden Gate Ave., Belvedere, Calif. 94920

[22] Filed: May 15, 1975

[21] Appl. No.: 577,900

[52] U.S. Cl. ..... 134/21; 15/1.7; 134/34

[51] Int. Cl.[2] ..... B08B 5/04

[58] Field of Search ..... 15/1.7; 134/94, 166, 134/167, 168 R, 21, 34; 210/169

[56] References Cited

UNITED STATES PATENTS

| | | | |
|---|---|---|---|
| 3,008,160 | 11/1961 | West | 15/1.7 |
| 3,080,590 | 3/1963 | Mullinix et al. | 15/1.7 |
| 3,172,415 | 3/1965 | Maushund | 15/1.7 X |
| 3,226,259 | 12/1965 | Armbrust | 15/1.7 |
| 3,707,737 | 1/1973 | Brower | 15/1.7 |
| 3,839,749 | 10/1974 | Blumenfeld et al. | 210/169 |

*Primary Examiner*—Theodore A. Granger
*Attorney, Agent, or Firm*—Naylor, Neal & Uilkema

[57] ABSTRACT

The stain remover apparatus includes an applicator head, a pole-like handle pivotally connected to it, a valve in the head to be opened by pressing the applicator head against the side or bottom of a pool, a bottle of stain remover liquid located on the pool deck, and a siphon hose connected between the bottle and the applicator head. The stain remover method is a method for priming said apparatus.

6 Claims, 5 Drawing Figures

STAIN REMOVER FOR SWIMMING POOLS, APPARATUS AND METHOD

SUMMARY OF THE INVENTION

An object of the invention is to provide swimming pool stain remover apparatus and a method of priming the same whereby the immediate area of the stain may be isolated and muriatic acid or other stain removing liquid may be applied to the area isolated.

A further object of the invention is to accomplish this through siphoning action under the control of an applicator valve located at the isolation area.

These and other objects and advantages of the invention will be apparent from the following description taken in conjunction with the drawing forming part of this specification, and in which.

Figure 5:
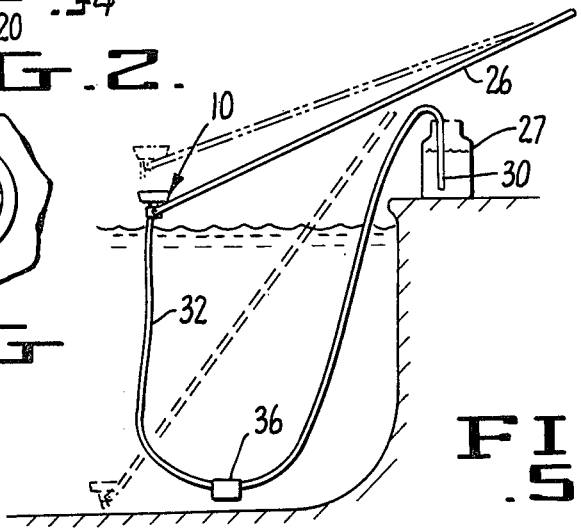
FIG. 5 is another perspective view illustrating the manner in which the stain remover apparatus is primed for stain removal usage.

Referring to the drawing, the stain remover device comprises an applicator head 10. The head 10 is comprised of a bowl 12 having a tubular extension 14, a cap 16 having a bead to groove snap-fit connection 18 with the extension 14, a valve stem 20 having an enlarged upper end 22 cooperatively related to a valve seat 24 formed on the tubular extension 14, a handle 26 pivotally attached to cap 16, a bottle 27 of muriatic acid having a vent 28 to atmosphere and a connection via tube 30 and hose 32 with the valve chamber 34 in cap 16. Slidably attached to the hose 32 is a weight 36 (FIG. 5) for a purpose described later.

The valve stem 20 is provided with ribs 38 which position and guide the stem relative to the tubular extension 14 and define flow passageways 40 between chamber 34 and the interior of bowl 12. The valve stem 20 is further provided with a heavy metal insert 42.

Figure 1:
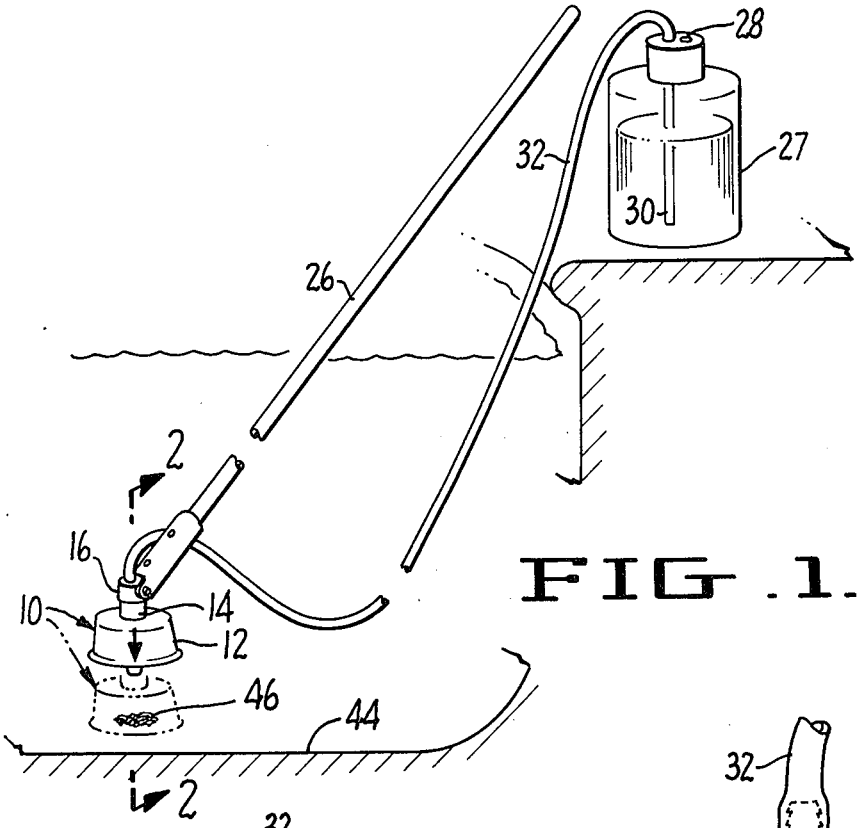
FIG. 1 is a view in perspective of a swimming pool and the stain removing apparatus of the invention.
Figure 2:
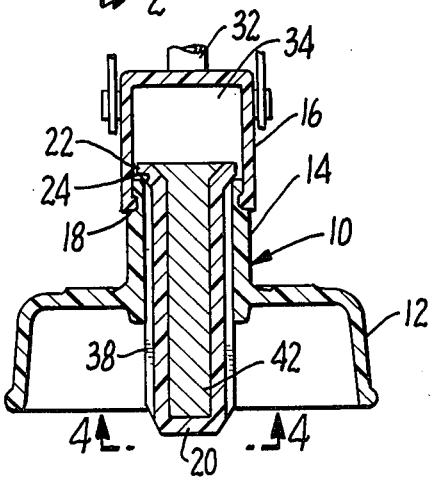
FIG. 2 is an enlarged detail view taken along lines 2—2 of FIG. 1.

When the valve is closed by engagement of valve element 22 with valve seat 24, the lower end of the valve stem extends below the lower end of bowl 12, as shown in FIG. 2. When the applicator head is engaged with a pool side wall or the pool floor 44 the stem 20 is moved up to open the valve and permit the flow of stain removing liquid into the bowl 12 which has been placed in isolating relation to a floor stain to be removed, such as that designated at 46 in FIG. 1.

Figure 3:
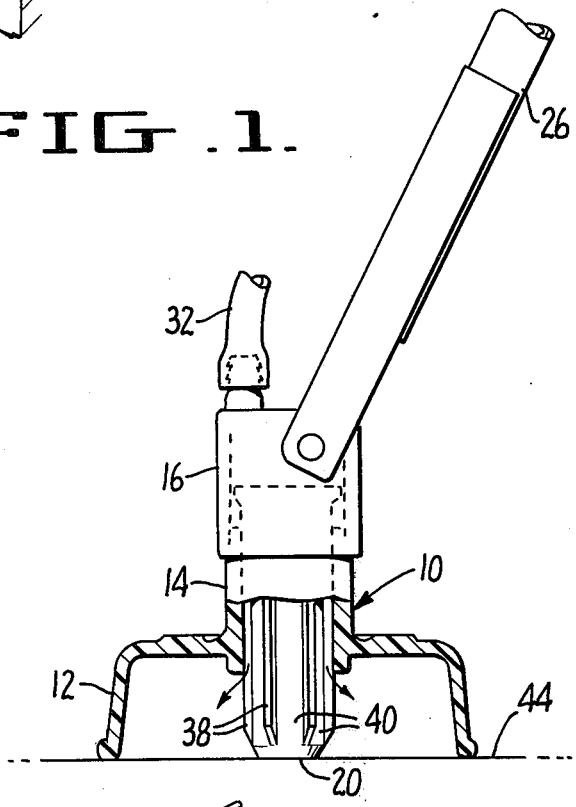
FIG. 3 is a side view, partly in elevation and partly in section, of the apparatus of FIG. 2.
Figure 4:
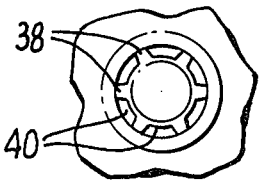
FIG. 4 is a view taken along lines 4—4 of FIG. 2.

To condition the apparatus for the flow of stain removing liquid to the interior of bowl 12, as in FIG. 3, the apparatus is primed in the following manner. The condition of the apparatus at the outset is that it is all disposed out of the pool water and the hose 32 is filled with air. The operator first submerges the head and as much of the hose as possible except for that part of the hose, about three feet in length, which extends from the surface of the water to the bottle 27, the applicator head being disposed close to the surface of the water and being turned upside down so that the valve is open. Water flows into the hose through the open valve to fill the entire submerged portion of the hose length, the air in the hose to one side of the weight 36 bubbling up out of the applicator head and the air to the other side of the weight bubbling up through the acid in bottle 27. This leaves air in the unsubmerged portion of the hose, i.e. between the water surface and the liquid in the bottle. The weight 36 is very important in the air removal procedure as it serves to remove kinks from the hose and to prevent hose kinking so that the air can escape from the hose. The vent opening 28 in the cap of bottle 27 allows the escape into the bottle of the air in the hose between the weight 36 and the water surface. The applicator head is then raised, still in the upside down or valve open position, to a height of about three feet above the water surface to force the air in the hose between the water surface and the bottle into the bottle and above the acid. Keeping the valve open the operator then lowers the applicator head into the water and then turns the head over to a right side up or valve closed condition, whereupon the device is conditioned for siphon-action use in which the stain removing liquid will continuously flow into the interior of the bowl 12 as long as the valve is open and the siphon-primed condition of the device will be retained by subsequent lifting of the applicator head to permit the closing of the valve under the action of gravity. The device is initially operated to remove the water from the hose, the completion of the water removal being apparent to the operator by the commencement of flow of the yellow-colored acid from the applicator head. When a stain removal application of the acid or other stain removing liquid has been completed, the remaining liquid in the hose can be returned to the bottle 27 by raising the applicator head about three feet above the water surface and turning the head upside down to open the valve.

There is thus provided a simple and efficient device for removing stains, e.g. rust stains, from the pool floor by applying muriatic acid or some other suitable rust removing liquid directly to the area of the stain. The valve control system of the applicator head allows the use of a minimum amount of acid to do the stain removing job, i.e. without unbalancing the chemical balance of the pool water. And in view of the priming method described above it is not necessary to employ any foot pump or other type of priming device along with the subject applicator system.

What is claimed is:

1. Stain remover apparatus for swimming pools comprising a bowl member open at its lower end and adapted to enclose and isolate a pool wall stain area, enclosure means associated with said bowl member defining a chamber for a stain remover liquid, a passageway interconnecting said chamber and the interior of said bowl member, and valve means to selectively open and close said passageway, said valve means including means automatically operable responsive to the bringing into engagement of said bowl member with the pool floor to open said passageway and automatically operable responsive to the removal of said bowl member from engagement with the pool floor to close said passageway.

2. The apparatus of claim 1, said enclosure means being carried by said bowl member, said apparatus further comprising a container for stain remover liquid located on the pool deck, and means including a hose connecting said container with said chamber for siphon-action dispensing of stain remover liquid from said apparatus.

3. Stain remover apparatus for swimming pools comprising a bowl member open at its lower end and adapted to be placed in enclosing relation to a pool wall stain, enclosure means associated with said bowl member defining a chamber for a stain remover liquid, a passageway interconnecting said chamber and the interior of said bowl member, and a valve member to open and close said passageway, said valve member comprising a vertically depending stem which normally extends past the lower end of said bowl member, the opening of said passageway being accomplishable by pressing said stem against the pool floor to raise said valve member relative to said bowl member and the closing of said passageway being accomplishable by lifting said bowl member away from the pool floor.

4. The apparatus of claim 3, said enclosure means being carried by said bowl member, said apparatus further comprising a container for stain remover liquid adapted to be located on the pool deck, and means including a hose connecting said container with said chamber for siphon-action dispensing of stain remover liquid from said apparatus.

5. The apparatus of claim 4, said apparatus further comprising a weight member attached to said hose by effecting the removal of air from said hose without permitting air blockage by the kinking of said hose.

6. In combination with pool stain remover apparatus comprising a vented container for stain remover liquid mounted on the deck of a swimming pool, an elongated hose with one end connected to said container and the other end connected to an applicator head at the end of an elongated handle and positioned adjacent the floor of the pool at an elevation lower than the level of said container, a valve located in said head for introducing liquid thereinto from said hose, and a control member to open and close said valve operable by the manipulator of said handle, the method of priming said apparatus for siphon-action dispensing of stain remover liquid to pool wall stains comprising submerging said hose, except for the container to water surface portion of said hose, and said head in a valve-open condition to displace the air from the submerged hose and replace the same with pool water, raising the head in a valve-open condition to a height above the surface of the pool water to displace the air from the container to water surface portion of said hose to said vent connection, re-submerging the previously submerged hose portion with the head in a valve-open condition, thereafter closing said valve, and thereafter opening said valve and displacing the water from said hose with stain remover liquid by causing the stain remover liquid to flow to the bottom of the pool within the applicator head.

* * * * *